US006226923B1

(12) United States Patent
Hicks et al.

(10) Patent No.: US 6,226,923 B1
(45) Date of Patent: May 8, 2001

(54) TILT WINDOW WITH DEFLECTION-REDUCING FEATURE

(75) Inventors: James Lawrence Hicks, York; Robert Leroy McKeel, Dallastown, both of PA (US)

(73) Assignee: Graham Architectural Products, York, PA (US)

( * ) Notice: Subject to any disclaimer, the term of this patent is extended or adjusted under 35 U.S.C. 154(b) by 0 days.

(21) Appl. No.: 09/313,451

(22) Filed: May 18, 1999

(51) Int. Cl.[7] ..... E05D 15/22
(52) U.S. Cl. ..... 49/196; 49/453
(58) Field of Search ..... 49/163, 172, 176, 49/168, 181, 182, 194, 195, 196, 453

(56) References Cited

U.S. PATENT DOCUMENTS

| | | | | |
|---|---|---|---|---|
| Re. 17,054 | | 7/1928 | Lewis . | |
| 506,240 | | 10/1893 | Kuersten . | |
| 624,418 | * | 5/1899 | Youlden | 49/196 |
| 628,104 | | 7/1899 | Marshall . | |
| 708,430 | | 9/1902 | Wall . | |
| 1,047,049 | | 12/1912 | Hartsfield . | |
| 1,426,561 | | 8/1922 | Fitzgerald . | |
| 2,213,989 | | 9/1940 | Martisius | 20/12 |
| 2,704,573 | | 3/1955 | Russell | 160/90 |
| 2,740,998 | | 4/1956 | Zitomer | 20/52.2 |
| 2,747,241 | * | 5/1956 | Marousky | 49/194 X |
| 2,761,498 | | 9/1956 | Reinhardt | 160/90 |
| 2,990,589 | | 7/1961 | Lynch | 20/49 |
| 3,290,825 | | 12/1966 | Adams | 49/431 |
| 3,399,490 | | 9/1968 | Hettinger | 49/414 |
| 3,499,248 | | 3/1970 | Baer | 49/430 |
| 4,887,389 | | 12/1989 | Haltof | 49/181 |
| 5,165,737 | | 11/1992 | Riegelman | 292/175 |
| 5,551,189 | | 9/1996 | Westfall | 49/76 |
| 5,657,579 | | 8/1997 | Bruchu et al. | 49/161 |

* cited by examiner

*Primary Examiner*—Jerry Redman
(74) *Attorney, Agent, or Firm*—Duane Morris & Heckscher, LLP; Steven E. Koffs

(57) ABSTRACT

A window assembly, comprises a frame and a sash. The frame has a jamb on at least a first side of the frame. The jamb has an inwardly extending flange. The sash is disposed within the frame. The sash has a stile with an outwardly extending flange along at least one portion of the stile adjacent the jamb. The outwardly extending flange is fixed relative to the sash. The outwardly extending flange is slidably movable adjacent to the inwardly extending flange. The sash has a first position in which the stile is substantially prevented from deflecting by the inwardly extending flange. The sash as a second position in which an end of the outwardly extending flange is positioned beyond an end of the inwardly extending flange, allowing the sash to pivot relative to the frame.

23 Claims, 11 Drawing Sheets

TILT WINDOW WITH DEFLECTION-REDUCING FEATURE

FIELD OF THE INVENTION

The present invention relates to building products generally, and specifically to tilt windows.

DESCRIPTION OF THE RELATED ART

Tilt windows have become prevalent in residential construction, in large part because of their convenience and attractive appearance. The sash of a tilt window is slidable in the vertical direction during ordinary use. To clean the tilt window, one or more latches at the top of the sash are released, permitting the sash to pivot inward for easy cleaning without completely removing the sash.

In the Architectural window class, a window having a test size of at least 1.5 meters× 2.4 meters (5 feet× 8 feet) is required by national standards to be capable of sustaining a load of at least 1900 Newtons per square meter (40 pounds per square foot) with a maximum deflection of any member of the assembly of L/175, where L is the length of the member.

In a window sash having a stile on each side, the maximum deflection under a wind load typically occurs at about the midpoint of the stile, where the wind force causes the stile to deflect inward towards the interior of the building. Thus, the deflection of the midpoint of the stile must be maintained below the L/175 limit.

To allow use of conventional tilt windows for structures that are required to meet the more stringent standards for commercial and architectural class windows, it is known to fasten (using screws or other removable fasteners) a bracket or brace to the window jamb at a height near the midpoint of the sash.

The brace or bracket maintains the maximum deflection below the L/175 limit, but prevents use of the normal tilt feature of the window. To tilt the window inward (e.g., for cleaning), the brace must be removed, typically requiring a tool. Once the brace is removed, there is a likelihood that it will become lost, or that the user will forget to replace the brace, completely defeating the purpose of providing the brace. In addition, the brace or bracket is unsightly.

SUMMARY OF THE INVENTION

The present invention is a window assembly, comprising a frame and a sash. The frame has a jamb on at least a first side of the frame. The jamb has an inwardly extending flange. A sash is disposed within the frame. The sash has a stile with an outwardly extending flange along at least one portion of the stile adjacent the jamb. The outwardly extending flange is fixed relative to the sash. The outwardly extending flange is slidably movable adjacent to the inwardly extending flange. The sash has a first position in which the stile is substantially prevented from deflecting by the inwardly extending flange.

OVERVIEW

Figure 1:
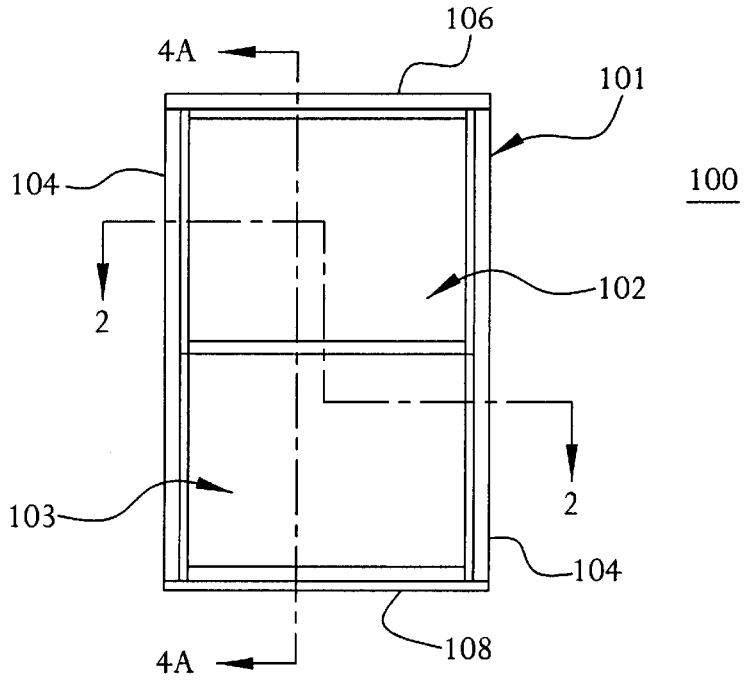
FIG. 1 is an elevation view of an exemplary window assembly according to the invention, as seen from outside of a building in which the window is mounted.

FIG. 1 shows a window assembly 100 according to the present invention. The window assembly 100 comprises a frame 101 and at least one sash, such as sashes 102 and 103. The frame 101 includes two jambs 104, ahead 106, and a sill 108.

Figure 2:
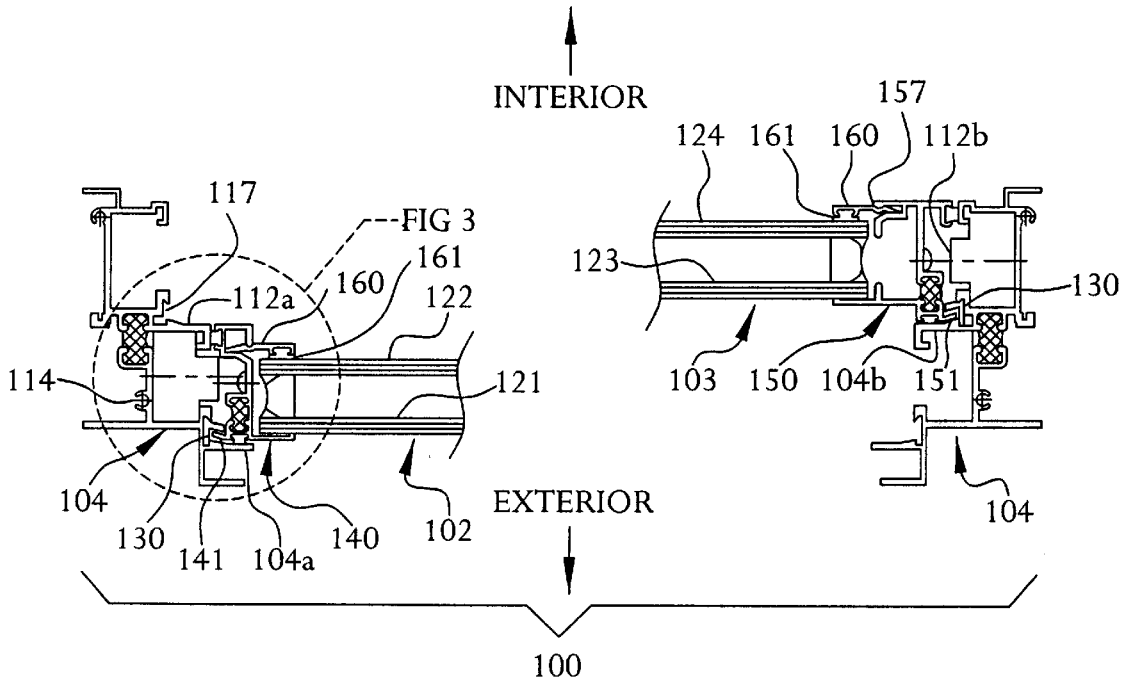
FIG. 2 is a cross-sectional view of the window assembly of FIG. 1, taken along section line 2—2.

FIG. 2 is a cross-sectional view of the window assembly of FIG. 1, taken along section line 2—2. FIG. 2 shows the left side of the top sash 102 and the right side of the bottom sash 103. Although not shown, the right side of the top sash 102 is a mirror image of the left side of the top sash, and the left side of the bottom sash is a mirror image of the right side of the bottom sash. The bottom of FIG. 2 corresponds to the exterior of a building, and the top of FIG. 2 corresponds to the interior of the building.

Figure 3:
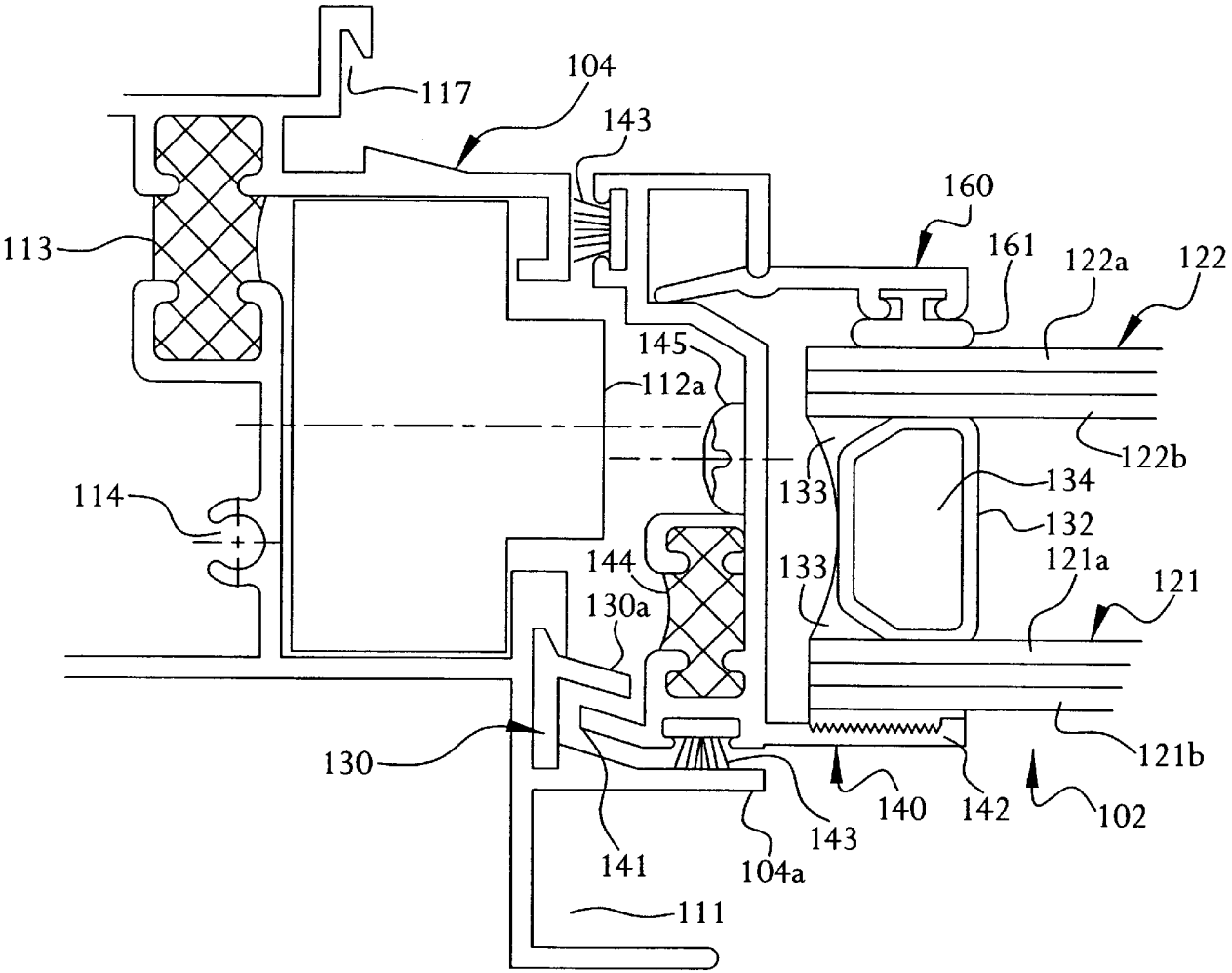
FIG. 3 is an enlarged plan view of the jamb and top stile extrusions shown in FIG. 2.

FIG. 3 is an enlarged view of the left end of the top sash 102. The jamb 104 has an elongate flange 104*a*. A stop means, such as stop 130 is attachable to the jamb 104. The stop 130 has a flange 130*a* that projects inwardly (towards the center of the sash 102) when the stop 130 is attached to the jamb 104.

The sash 102 has a stile 140. Stile 140 has an outwardly extending flange 141 along at least one portion of the stile of the sash adjacent the jamb 104. The outwardly extending flange 141 extends outward (away from the center of the sash 102, towards the jamb 104). The outwardly extending flange 141 is slidably movable between the elongate flange

104*a* of the jamb 104 and the flange 130*a* of the stop, as the sash is raised or lowered FIG. 2 also shows the bottom sash 103. The bottom sash 103 has a stile 150. Stile 150 has an outwardly extending flange 151 along at least one portion of the side of the sash adjacent the jamb 104. The outwardly extending flange 151 extends outward (away from the center of the sash 103, towards the jamb 104). The jamb 104 has a second stop 130 for the bottom sash 103. The outwardly extending flange 151 is slidably movable between the flange 104*b* of jamb 104 and the flange 130*a* of the stop, as the sash 103 is raised or lowered.

Figure 5:
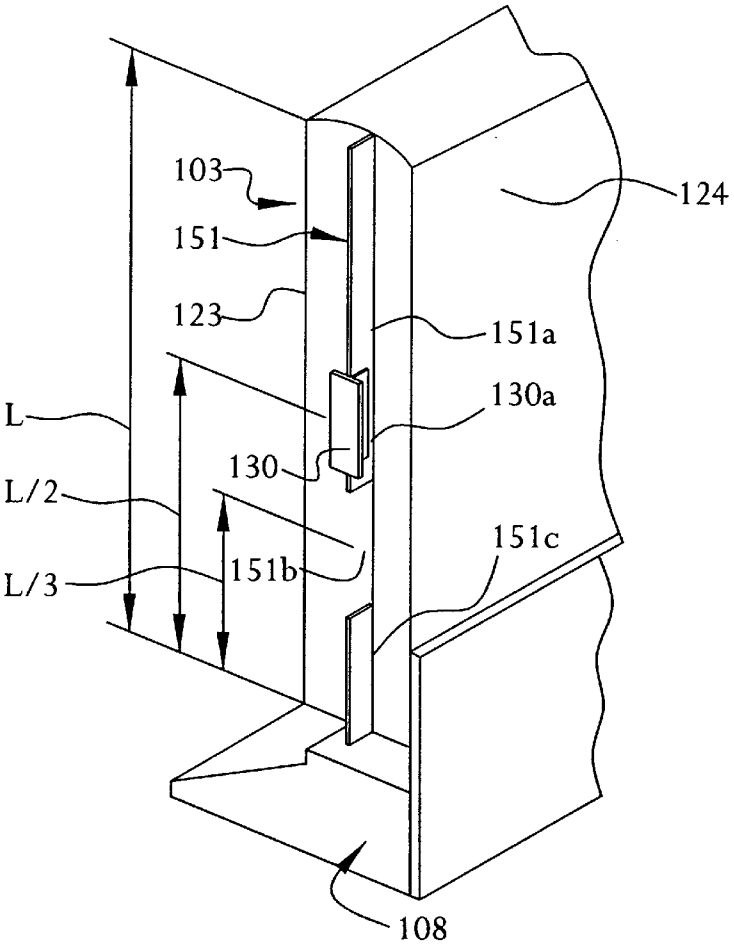
FIG. 5 is a simplified isometric sketch showing the sash flange and outwardly extending flange of FIG. 3, when the window is in the closed position.

FIG. 5 is a simplified isometric sketch showing the outwardly extending flange (flange 151) of bottom sash 103 and the stop 130, when the sash 103 is in the closed position. The jamb 104 is omitted from FIG. 5 for ease of viewing the outwardly extending flange 151 and stop 130. Only the stop 130 is shown, at an approximate height in which the stop would be located on the jamb 104. If the jamb were shown with the sash 103 installed in the jamb 104, the stop and the flange of the frame would be hidden when the sash is in this position (See, for example, FIG. 1).

Figure 7:
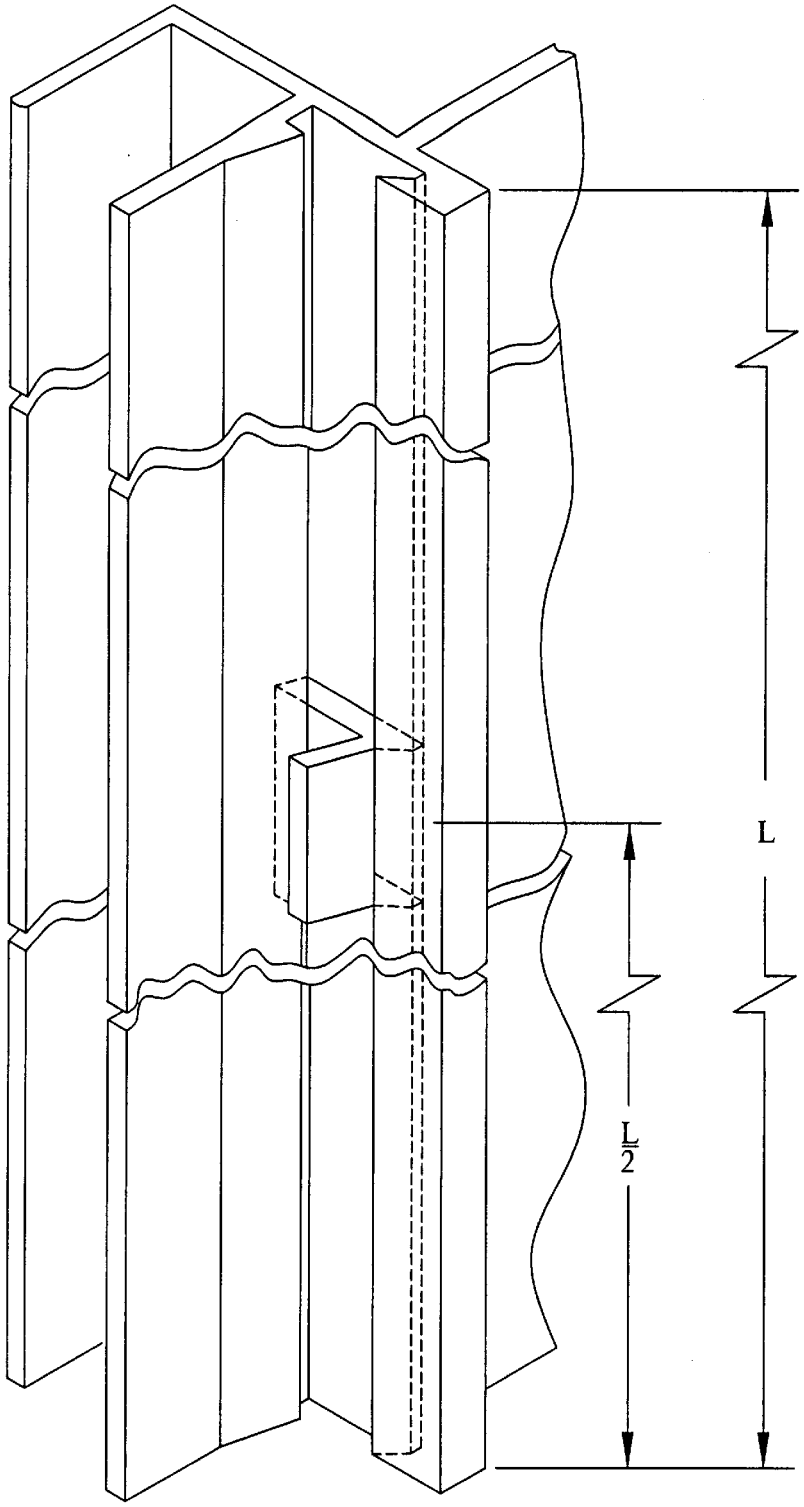
FIG. 7 is an isometric view of a portion of the jamb shown in FIG. 3.

FIG. 7 is an isometric view of a portion of the jamb 104, showing the positioning of the stop. As shown in FIG. 7, the length "L" represents the height of the sash 103. The stop 130 is positioned at approximately the midpoint of the height of the sash 103.

Referring again to FIG. 5, the outwardly extending flange 151 of the sash 103 may have a first outwardly extending flange portion 151*a* and a second outwardly extending flange portion 151*c* separated by a space or cutout 151*b*. The first outwardly extending flange portion 151*a* extends to approximately the top end of the sash 103, and the second outwardly extending flange portion 151*c* extends to approximately the bottom end of the sash opposite the first end of the sash. The space or cutout 151*b* may, for example, be located at a distance from the bottom of the sash of approximately one third of the height of the sash, or other suitable locations may be used. The space or cutout 151*b* is at least as long as the flange 130*a* of the stop 130.

The space or cutout 151*b* may be alternatively located at a position different from one third of the height of the sash 103. If the cutout is located closer to the bottom of the sash 103, then the sash must be raised by a distance greater than one sixth of the sash height to align the cutout with the stop for pivoting the sash inward. The cutout 151*b* should be positioned far enough from the midpoint of the sash 103 so that the sash 102 clears the sill 108 when the cutout is aligned with the stop 130.

The lower portion 151*c* is not required to perform any function. It may, however, be easier to form flange 151 along the complete length of the sash 103, and form a cutout 151*b* therein, than to form the flange along only a portion of the sash. Alternatively, the cutout 151*b* may extend to the bottom of the sash, so that there is only one portion 151*a* of the flange present.

The stop 130 is located at a height approximately equal to one half of the height of the sash 103. When the sash 103 is in the closed position shown in FIG. 5, the stile of the sash is prevented from deflecting by the flange 151 of the frame and the flange 130*a* of the stop 130. (The sash is also prevented from pivoting inward.) The stop 130 may be about 7.5 centimeters (3 inches) high. Other lengths may be used, so long as the stop is of sufficient strength and stiffness to limit deflection of the stiles 140 and 150 to a desired level.

Although an elevation view of the outwardly extending flange 141 of the top sash 102 is not included herein, flange 141 is similar to flange 151, and the positioning of stop 130 in the slot 117 for the upper sash 102 is similar to that shown and described above with respect to the lower sash 103. That is, the stop 130 in slot 117 is at a height approximately corresponding to the midpoint of top sash 102 in the position of FIG. 4A, and the cutout of flange 141 is at a distance of about one third the height of the top sash 102 (the distance being measured from the top of the top sash.) Thus, the top sash 102 is lowered by a distance of about one sixth of the height of the sash to reach the pivoting position. The location of the cutout in flange 141 may also be varied to provide a different pivoting position for the top sash, in the manner described above with respect to the bottom sash.

Figure 6:
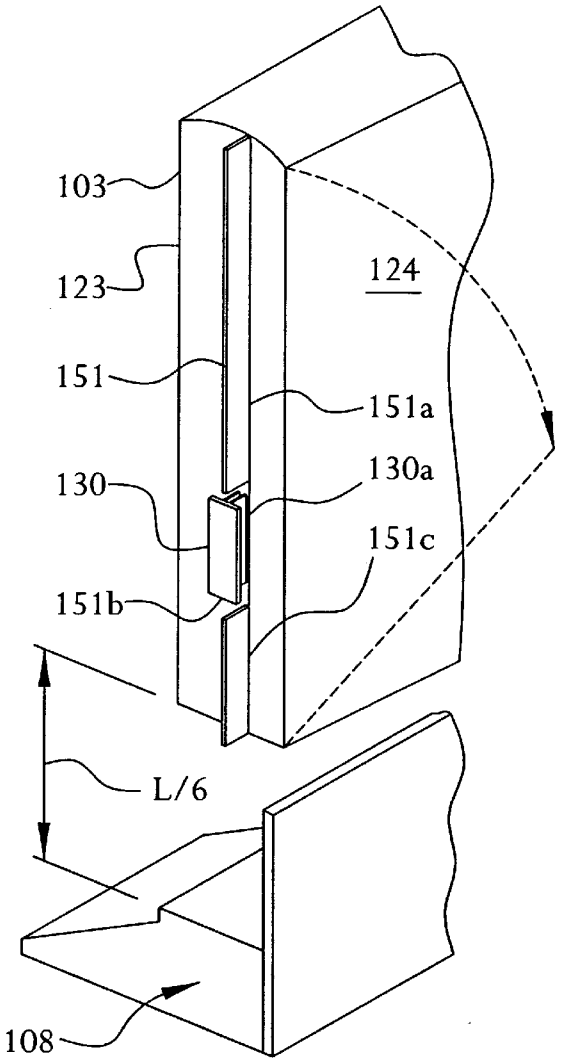
FIG. 6 shows the sash flange and outwardly extending flange of FIG. 5, when the window is in the partially open position for releasing the outwardly extending flange.

FIG. 6 shows the sash 103 and outwardly extending flange 151 of FIG. 5, when the sash 103 is in the partially open position for releasing the outwardly extending flange 151. The sash is slidably raised to a height of about one sixth of the height of the sash. At this height, the cutout 151*b* of outwardly extending flange 151 lines up with the stop 130 of the sash 103. In this position, the bottom end of the outwardly extending flange portion 151*a* is positioned beyond the top of stop 130, allowing the sash 103 to pivot relative to the frame 101.

The structure described above provides great strength in a tiltable window, sufficient to withstand high wind loads with minimal deflection. In particular, if a stop 130 is provided on each side of the sash 103, then the flange 130*a* of each respective stop 130 provides a bearing surface that is sufficiently strong and stiff to resist at least one half of the maximum expected wind pressure force applied against the sash 103, and transmitted via the outwardly extending flange 151 of the sash to the stop. Then the two stops 130 together can withstand the maximum combined load.

Further details of the exemplary embodiment are described below.

DETAILED DESCRIPTION

Figure 8B:
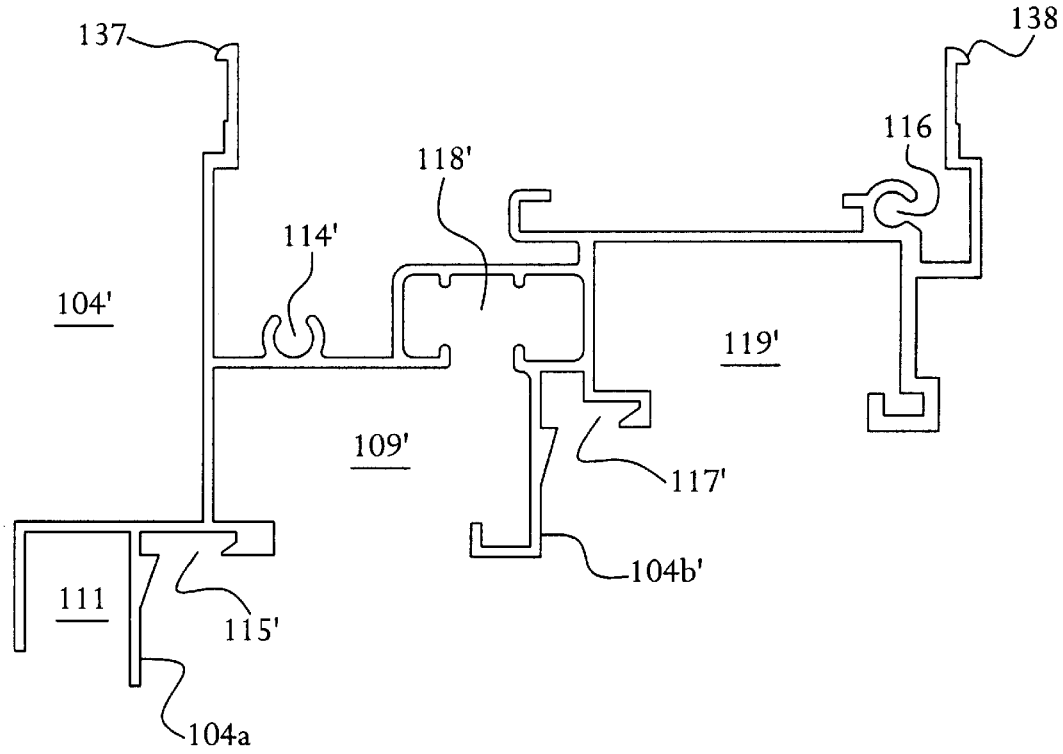
FIG. 8B is an end view of a variation of the jamb extrusion shown in FIG. 7.
Figure 8A:
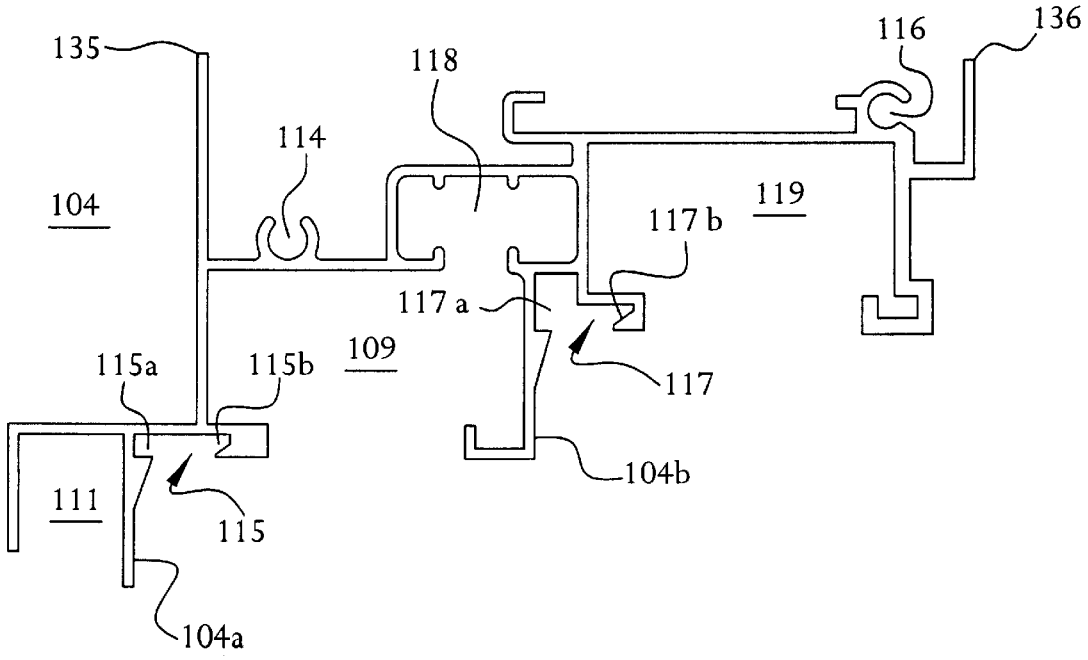
FIG. 8A is an end view of the jamb extrusion shown in FIG. 3.

FIGS. 2, 3, and 8A show an end view of an extrusion for a window jamb 104 suitable for use in accordance with the invention. A single jamb extrusion 104 may be used for both the right and left sides of the window frame 101. The right jamb 104 is a mirror image of the left jamb 104, and is obtained by merely flipping the extrusion by 180 degrees. (The same is true for the stop 130, the top stile 140 and the bottom stile 150.)

The jamb 104 has two slots 115 and 117 for receiving respective stops 130. The slots 115 and 117 may be identically shaped, if the stops 130 are identically shaped. Alternatively, each slot may have a different cross section, if the stops for the upper and lower sashes are shaped differently from each other (not shown). The descriptions of slots 115 and 117, below, are identical to each other.

Figure 9:
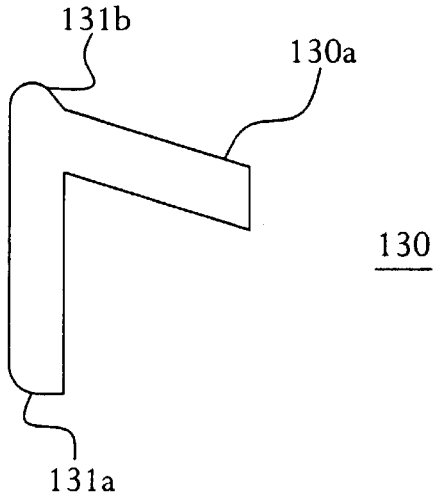
FIG. 9 is an end view of the outwardly extending flange extrusion shown in FIG. 3.

In the example, the slot 115 (117) is asymmetrical. The slot 115 (117) has a rectangular portion 115*a* (117*a*) and a wedge shaped portion 115*b* (117*b*). By using a different cross section shape for each end of the slot 115 (117), correct orientation of the (non-symmetrical) stop 130 is assured. FIG. 9 shows the exemplary stop 130. Stop 130 has a heel-shaped portion 131*a* that fits into slot portion 115*a* (117*a*), and a foot shaped portion 131*b* that fits into slot portion 115*b* (117*b*).

Alternative cross sections may be used for the stop 130. The heel 131*a* and foot 131*b* are not required shapes; these shapes are used in the exemplary embodiment to conform to the shape of slot 115. Any complementary shapes may be used for slot 115 and stop 130. Also, the design of the slot and the stop may be varied so that the stop is symmetrical.

The exemplary stop means 130 is a separate component mounted in position in slot 115 (117) by, for example, crimping welding, soldering, or by use of an adhesive. In an alternative variation (not shown), the stop means may be formed integrally as a part of the same extrusion as the jamb. Since the extrusion would have a constant cross section from top to bottom, the stop would extend from the top to the bottom immediately after extrusion. The top and bottom portions of the stop flange would then be cut off using a conventional cutting tool, so that a short stop flange having the desired length would remain, positioned at a height approximately adjacent to the center of the sash.

With the stop 130 installed, the combination of the elongated flange 104*a* and the stop flange 130*a* form a channel for slidably receiving the outwardly extending flange 141 of the top stile 140. The elongated flange 104*a* prevents the sash 102 from pivoting outward. The stop flange 130*a* substantially prevents the stile 140 of sash 102 from deflecting or bowing inward. In particular, stop flange 130*a* substantially prevents deflection under wind loading. In the exemplary embodiment, the stop flange 130*a* prevents the stile 140 from deflecting by more than L/175 at the center of stile 140. The stop flange 130*a* also prevents the sash 102 from pivoting inward, unless the sash 102 is specifically placed at the pivoting height L/6 shown in FIG. 6.

Similarly, for the bottom sash, the combination of the elongated flange 104*b* and the stop flange 130*a* form a channel for slidably receiving the outwardly extending flange 151 of the bottom stile 150. The elongated flange 104*b* prevents the sash 103 from pivoting outward. The stop flange 130*a* substantially prevents the stile 150 of sash 103 from deflecting.

As best seen in FIGS. 2 and 3, when the sash is in its closed position with the outwardly extending flange 141 (or 151) slidably received between stop flange 130*a* and elongated flange 104*a* (or 104*b*), the stop 130 and the outwardly extending flange 141 (or 151) are completely concealed from view by an observer on the interior of the building.

Other aspects of the window assembly shown in the exemplary embodiments are now described.

FIGS. 3 and 8A show the jamb 104. The jamb 104 has a channel 109 for the balance shoe 112*a* of the top sash and a channel 119 for the balance shoe 112*b* of the bottom sash. A balance shoe is a conventional mechanism that allows the sash to be slidably raised and lowered between the right and left jambs (FIG. 4A), or pivotally tilted inward for cleaning (FIG. 4B). In a typical configuration, the sash 102 has a non-circular pin 129 (FIGS. 4A and 4B) projecting outwardly on each side at the bottom of the sash. The balance shoes 112*a* and 112*b* have cams (not shown) that receive the pins of the sash. When the sash 102 is raised or lowered, the balance shoe and cam move up and down correspondingly, within the respective channels 109 and 119. When the sash 102 is pivoted inward (as shown in FIG. 4B), the cam (not shown) rotates, but is locked from being raised or lowered until the sash is returned to its normal position (FIG. 4A).

Figure 4A:
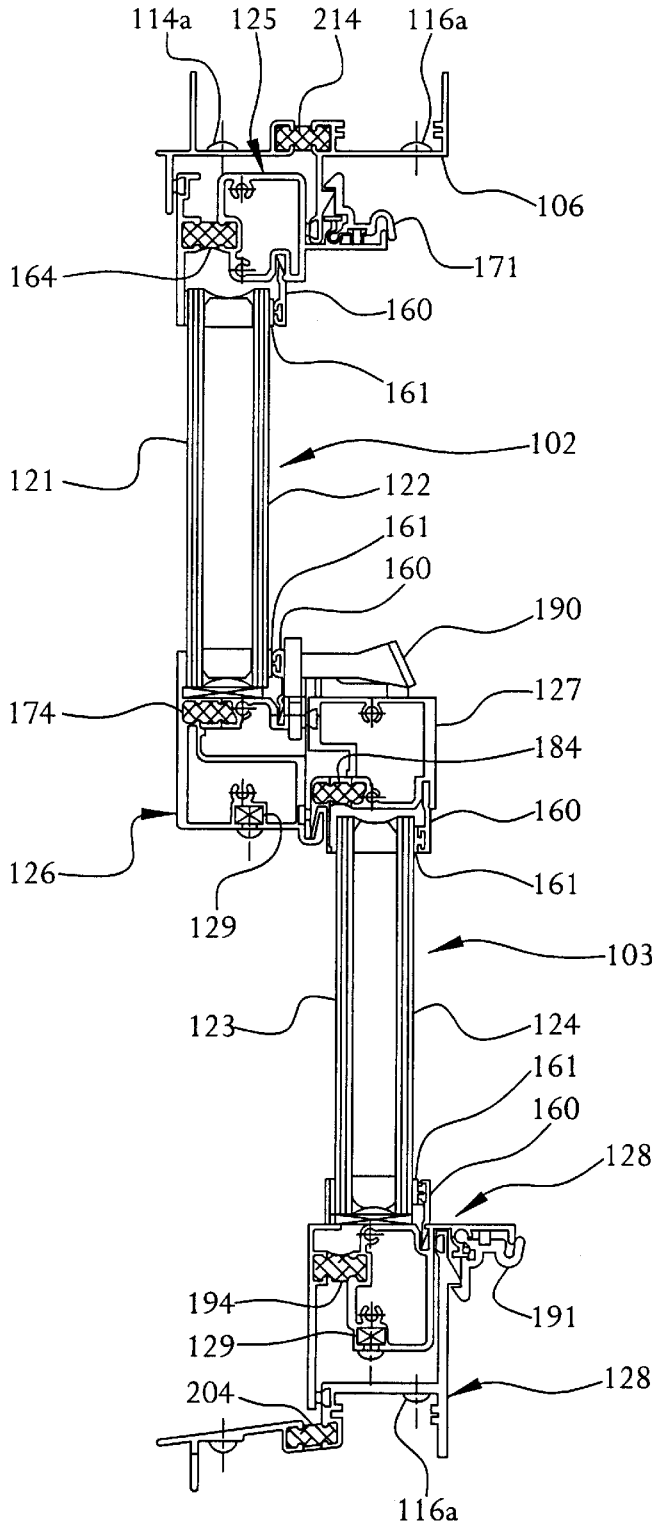
FIG. 4A is a cross sectional view of the window assembly of FIG. 1, taken along section line 4A—4A.
Figure 4B:
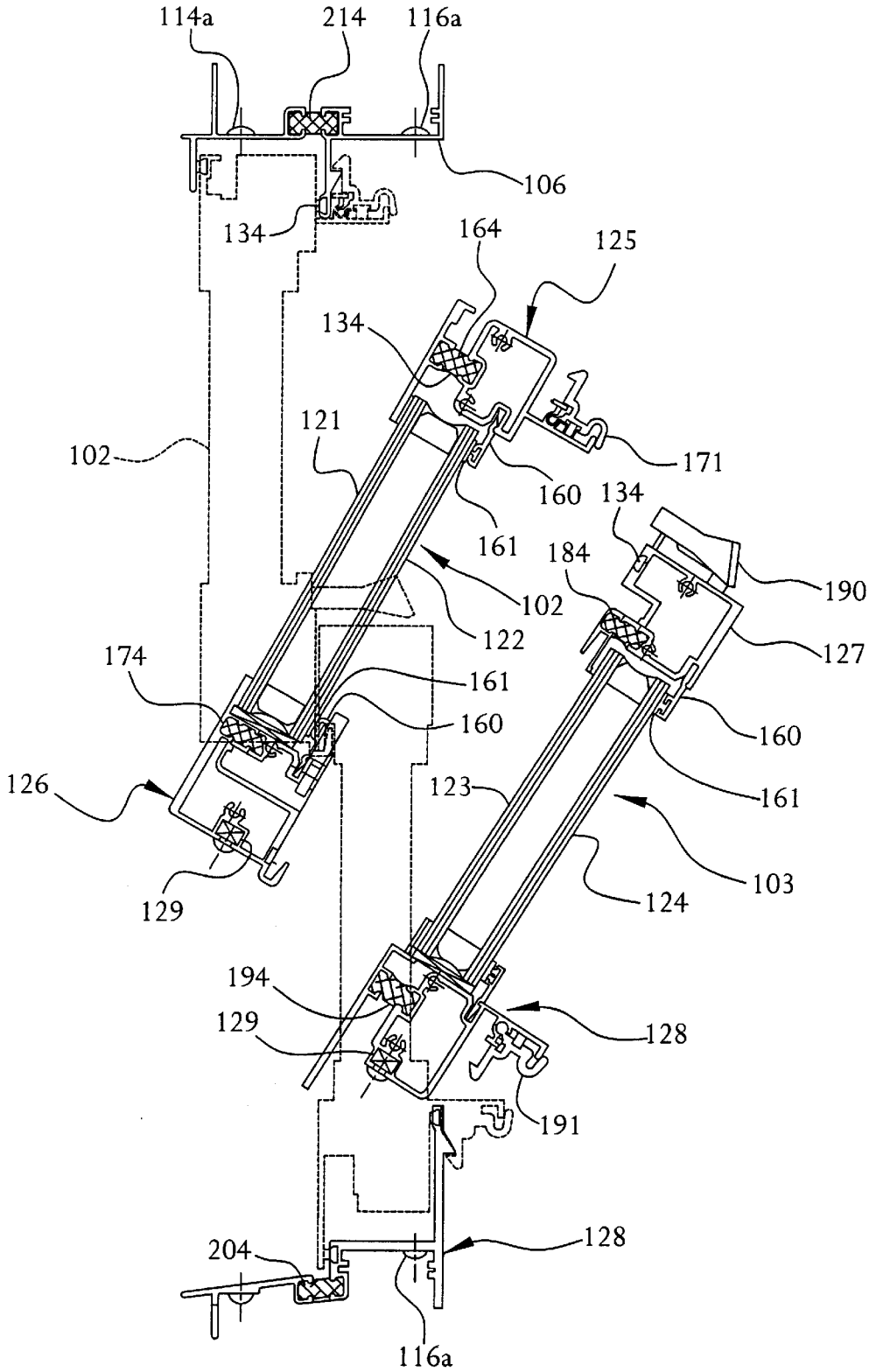
FIG. 4B shows the window of FIG. 4A, with the top and bottom sashes in the tilted position. The sashes appear in the closed position in phantom.

The top sash 102 and bottom sash 103 may each have conventional spring loaded pins or latches (not shown) that are biased to project outwardly into the balance shoe channels, when the sashes are in the positions shown in FIG. 4A. In the exemplary embodiment, the stop 130 and outwardly extending flange 141 (or 151) prevent the window from pivoting inward unless the stop 130 is aligned with the cutout 151*b* of the lower sash (not shown for the upper sash). The spring loaded pins or latches prevent the sash 102 (or 103) from inadvertently pivoting inwardly when the sash is moved past the pivot position (i.e., when the lower sash is raised one sixth of its height, or the upper sash is lowered by one sixth of its height).

To pivot the sash 102 or 103 inward (e.g., for cleaning), the bottom sash 103 is raised (or top sash 102 is lowered) by about one sixth of its height, and the spring loaded pins or latches are manually pressed inward, to release the top of the sash 103 (or 102) from the jamb 104. To make it easier to align the sash 102 or 103 at the height for pivoting, indicia may be placed on the jamb 104 and/or the stile 150. Any indicia may be used, including printed matter. A dimple may be a preferred form of indicia, because a dimple is unobtrusive and cannot be inadvertently peeled or rubbed off.

In addition to the features described above, jamb 104 has a screen track 111 for receiving a conventional screen. Jamb 104 may also have a lightweight material 113 added in channel 118 to strengthen the jamb. This material may be, for example, a conventional two-part polyurethane resin or equivalent material. Two screw receiving ports 114 and 116 receive screws 114*a* and 116*a* (FIGS. 4A and 4B) that are used to fasten the head 106 and sill 108 to the jambs 104.

The panes 121 and 122 are mounted with a spacer 132 therebetween. The spacer may, for example, be formed of aluminum, and filled with a desiccant 134. The spacer is generally formed in a rectangle, at the top, bottom, left and right sides of the sash 102. When the panes 121 and 122 are mounted on the spacer 132, and a sealant 133 is applied. The sealant may, for example be a silicone based adhesive or the like.

FIG. 8B shows a mulling jamb 104' that may be used to install two of the exemplary windows side-by-side. In a side-by-side configuration (not shown), the two outer jambs and one of the two inner jambs are of the type shown in FIG. 8A. The remaining inner jamb is a mulling jamb 104' of FIG. 8B. The mulling jamb has two projections 137 and 138 that fit inside of the respective walls 135 and 136 in the neighboring jamb 104. The gaps between the walls 135 and 136 and the projections 137 and 138 are then filled with a pliable sealant (e.g., silicone or acrylic). Other features of mulling jamb 104' are identical to those in jamb 104, as described above.

Figure 15:
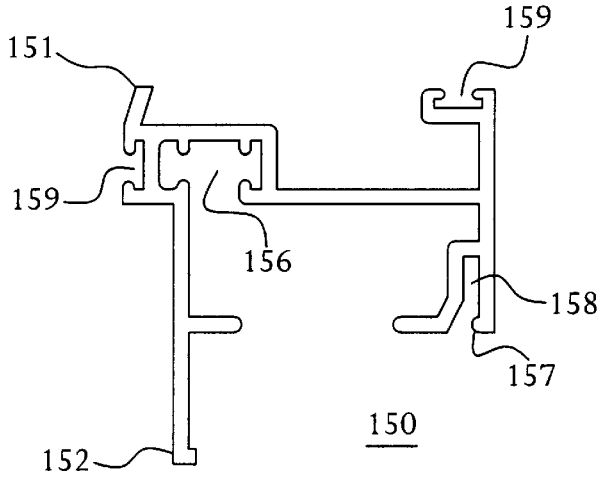
FIG. 15 is an end view of the bottom stile extrusion shown in FIG 2.
Figure 14:
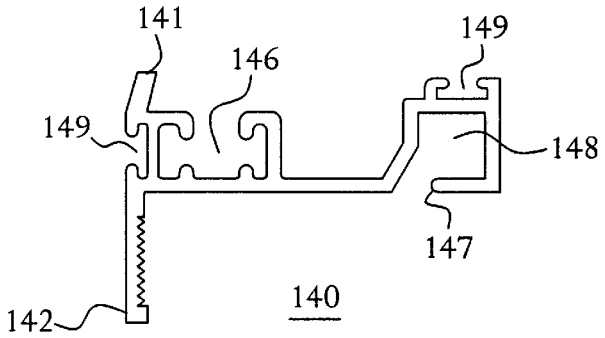
FIG. 14 is an end view of the top stile extrusion shown in FIG. 3.

FIGS. 14 and 15 show the top stile 140 and bottom stile 150, respectively. An exemplary stile 140 is best seen in situ in FIG. 3. The top stile 140 has an outwardly extending flange 141, and the bottom stile 150 has an outwardly extending flange 151. The operation of these flanges is described above. The stiles 141 and 151 retain the window panes 121–124 in place. The panes 121, 122 are retained between the glazing leg 142 and a spline 161 (FIG. 3). The spline 161 is in turn held in place by a glazing bead 160 (FIG. 3). The glazing bead 160 is secured in a channel 148 by its engagement with retaining wall 147 of stile 140. Similarly, the panes 123, 124 are retained between the glazing leg 152 and a spline 161 (FIG. 2). The spline 161 is in turn held in place by a glazing bead 160 (FIG. 2). The glazing bead 160 is secured in a channel 158 by its engagement with retaining wall 157 of stile 150.

As best seen in FIG. 14, stile 140 has two channels 149 for receiving weather stripping 143 (FIG. 3). A channel 146 receives a lightweight material 144 such as a two part polyurethane or the like. Screws 145 or similar fasteners are used to attach the stile to the top rail 125 (FIG. 10) and the keeper rail 126 (FIG. 11).

Figure 10:
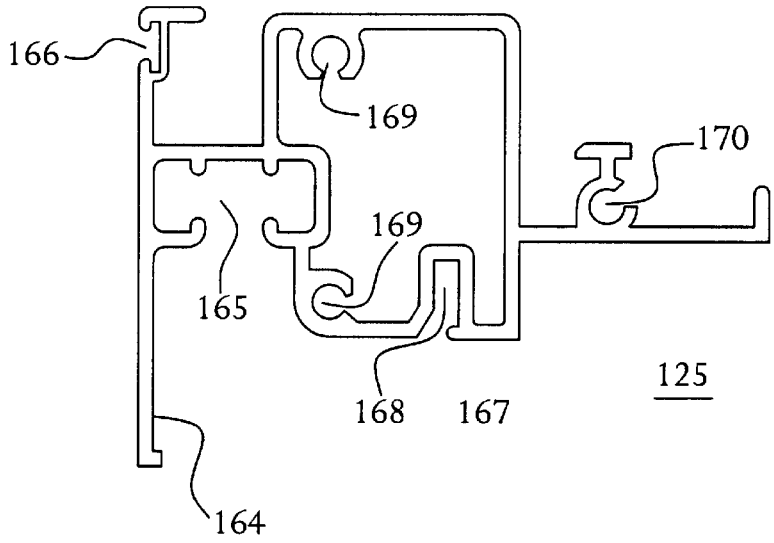
FIG. 10 is an end view of the top rail extrusion shown in FIG. 4.

FIGS. 4A and 10 show the top rail 125 of the top sash 102. Top rail 125 has a glazing leg 164. Panes 121 and 122 are retained in place between glazing leg 164 and a spline 161 (FIG. 4A). The spline 161 is held in place by a glazing bead 160 secured in the channel 168, and engaging retaining wall 167. A channel 165 is filled with a rigid, lightweight material 164 such as a two part polyurthane (FIG. 4A). A channel 166 retains weather stripping material 143. Two screw ports 169 receive the fasteners that attach the top stiles 140 to the top rail 125. A latch port 170 receives a latch 171 (FIG. 4A) that locks the top sash in the closed position.

Figure 11:
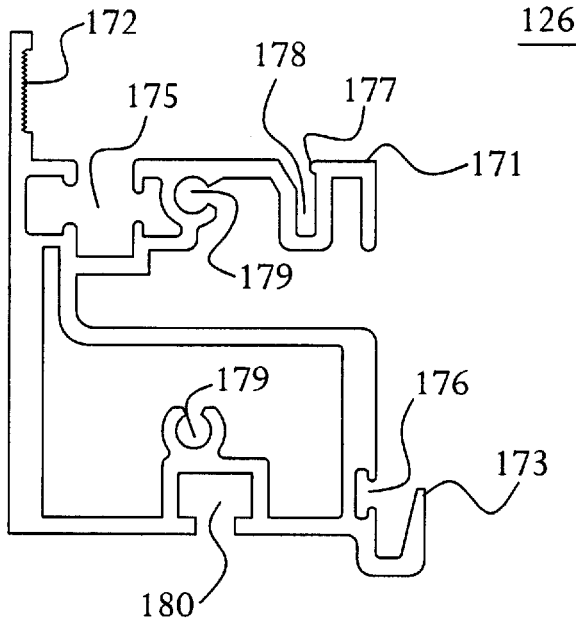
FIG. 11 is an end view of the keeper rail extrusion shown in FIG. 4.

FIGS. 4A and 11 show the keeper rail 126 of the top sash 102. Keeper rail 126 has a glazing leg 172. Panes 121 and 122 are retained in place between glazing leg 172 and a spline 161 (FIG. 4A). The spline 161 is held in place by a glazing bead 160 secured in the channel 178, and engaging retaining wall 177. A channel 175 is filled with a rigid, lightweight material 174 such as a two part polyurethane (FIG. 4A). Two screw ports 179 receive the fasteners that attach the top stiles 140 to the bottom rail 126. A mounting surface 171 holds the catch (not shown) of the window lock 190. A channel 176 retains weather stripping material 143. An upwardly projecting flange 173 receives a mating flange 183 of the lock rail 127 to secure the top and bottom sashes in a weather-tight relationship when both sashes are closed (as shown in FIG. 4A). A latch port 196 receives a latch 191 that secures the lower sash in the closed position. A channel 180 holds the outwardly projecting members 129, about which the top sash 102 pivots for cleaning.

Figure 12:
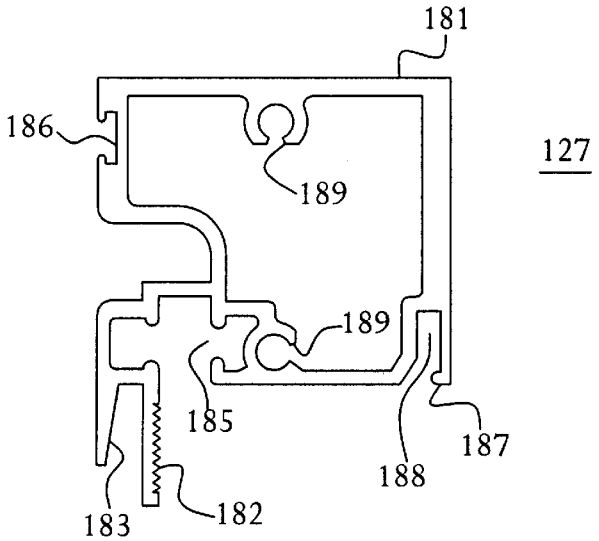
FIG. 12 is an end view of the lock rail extrusion shown in FIG. 4.

FIGS. 4A and 12 show the lock rail 127 of the bottom sash 103. Lock rail 127 has a glazing leg 182. Panes 123 and 124 are retained in place between glazing leg 182 and a spline 161 (FIG. 4A). The spline 161 is held in place by a glazing bead 160 secured in the channel 188, and engaging retaining wall 187. A channel 185 is filled with a rigid, lightweight material 184 such as a two part polyurethane (FIG. 4A). Two screw ports 189 receive the fasteners that attach the bottom stiles 150 to the lock rail 127. A mounting surface 181 holds the window lock 190. Two spring-biased latches (not shown) are also mounted on the ends of mounting surface 181, for preventing the sash 103 from pivoting inward, except when pivoting is desired for cleaning. A channel 186 retains weather stripping material 143. An downwardly projecting flange 183 is received by a mating flange 173 of the keeper rail 126 to secure the top and bottom sashes in a weather-tight relationship when both sashes are closed (as shown in FIG. 4A).

Figure 13:
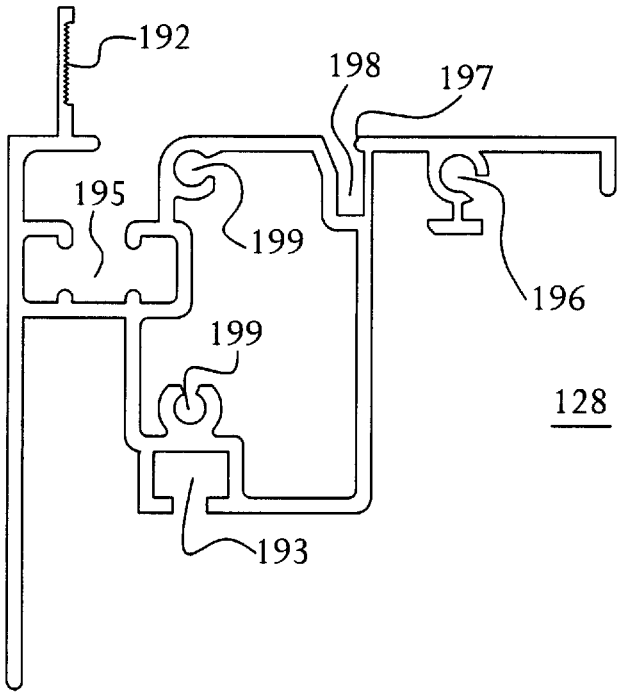
FIG. 13 is an end view of the bottom rail extrusion shown in FIG. 4.

FIGS. 4A and 13 show the bottom rail 128 of the bottom sash 103. Bottom rail 128 has a glazing leg 192. Panes 123 and 124 are retained in place between glazing leg 192 and a spline 161 (FIG. 4A). The spline 161 is held in place by a glazing bead 160 secured in the channel 198, and engaging retaining wall 197. A channel 195 is filled with a rigid, lightweight material 194 such as a two part polyurethane (FIG. 4A). Two screw ports 199 receive the fasteners that attach the bottom stiles 150 to the bottom rail 128. A channel 193 holds the outwardly projecting members 129, about which the lower sash pivots for cleaning. A latch port 196 receives a latch 191 that secures the lower sash in the closed position.

Figure 16:
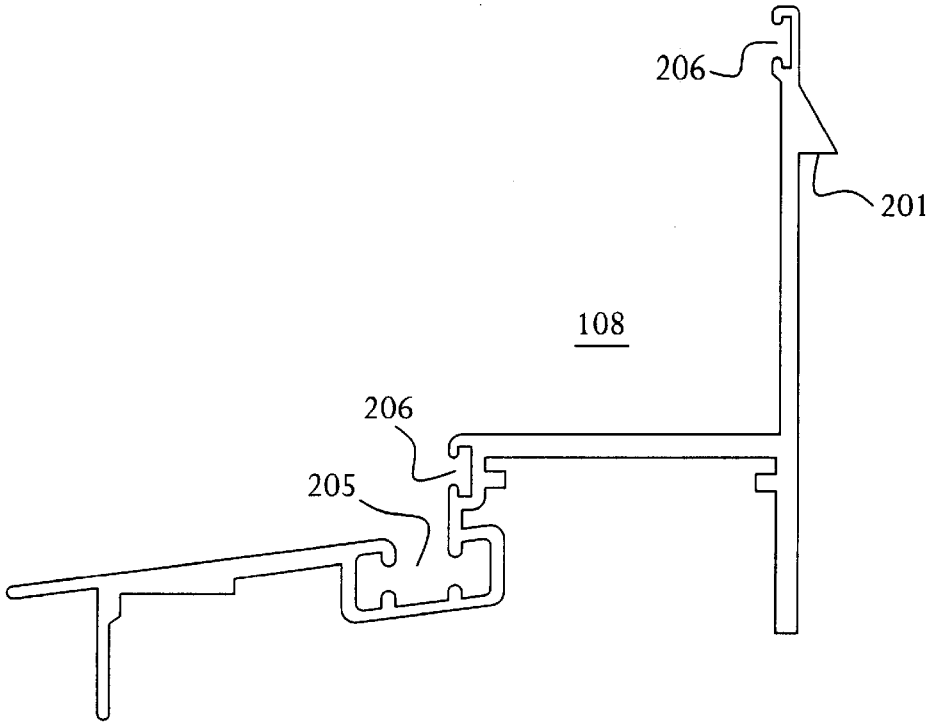
FIG. 16 is an end view of the sill extrusion shown in FIG. 4.

FIG. 16 shows the sill extrusion 108. The sill 108 has two channels 206 for receiving weather stripping 143. A channel 205 is filled with a rigid, lightweight material 204 such as a two part polyurethane (FIG. 4A). A tooth 201 is engageable by the latch 191 of the bottom rail 128, to secure the lower sash 103 in the closed position.

Figure 17:
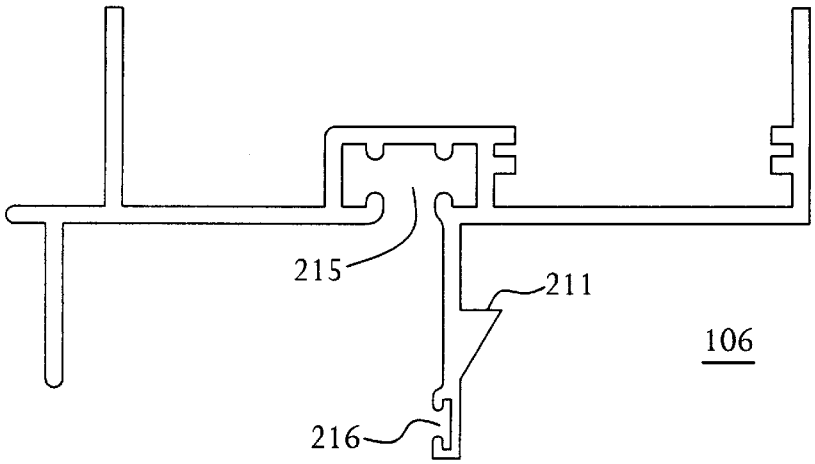
FIG. 17 is an end view of the head extrusion shown in FIG. 4.

FIG. 17 shows the head extrusion 106. The head 106 has a channel 216 for receiving weather stripping 143. A channel 215 is filled with a rigid, lightweight material 214 such as a two part polyurethane (FIG. 4A). A tooth 211 is engageable by the latch 171 of the top rail 125, to secure the top sash 102 in the closed position.

Windows fabricated according to the exemplary embodiment of the present invention achieve the convenience of conventional tilt windows with enhanced resistance to deflection. For example, the window assembly may be an Architectural class window having a test size of at least 1.5 meters×2.4 meters (5 feet×8 feet), and the window is capable of sustaining a load of at least 1900 Newtons per square meter (40 pounds per square foot) with a maximum deflection of any member of the assembly of L/175, where L is the length of the member.

Further, the exemplary embodiment does not require the removal and re-mounting of a separate deflection reducing brace every time the window is to be tilted in for cleaning. In the exemplary embodiment, when the sash is installed in the frame, the anti-deformation feature is deployed without requiring any separate steps by the user. Because the stop means is integrally attached to (i.e., secured to, or part of) the jamb, the stop means cannot become lost or separated from the window. The exemplary window can also be tilted in for cleaning in fewer steps and in less time than prior art windows that have a separate brace.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A window assembly, comprising:

a frame having a jamb on at least a first side thereof, the jamb having an inwardly extending flange; and a sash disposed within the frame, the sash having a stile with an outwardly extending flange along at least one portion of the stile adjacent the jamb, the outwardly extending flange being fixed relative to the sash, the outwardly extending flange being slidably movable adjacent to the inwardly extending flange, the sash having a first position in which the outwardly extending flange engages the inwardly extending flange, and the stile is substantially prevented from deflecting in a direction normal to a plane of the sash by the inwardly extending flange.

2. The window assembly of claim 1, wherein the sash has a second position in which an end of the outwardly extending flange is positioned beyond an end of the inwardly extending flange, and the outwardly extending flange does not engage the inwardly extending flange, allowing the sash to pivot relative to the frame.

3. The window assembly of claim 2, wherein the inwardly extending flange of the jamb is hidden when the sash is in the first position.

4. The window assembly of claim 1, wherein the outwardly extending flange of the sash has first and second outwardly extending flange portions separated by a space or cutout.

5. The window assembly of claim 4, wherein the first outwardly extending flange portion extends to approximately a first end of the sash, and the second outwardly extending flange portion extends to approximately a second end of the sash opposite the first end of the sash.

6. The window assembly of claim 4, wherein the space or cutout is located at a distance from the bottom of the sash of approximately one third of the height of the sash.

7. The window assembly of claim 4, wherein the space or cutout is at least as long as the inwardly extending flange.

8. The window assembly of claim 1, wherein the inwardly extending flange is located at a height approximately equal to one half of the height of the sash.

9. The window assembly of claim 1, wherein the sash has a stile on each respective side thereof, and the window has a test size of at least 1.5 meters×2.4 meters, and the window is capable of sustaining a load of at least 1900 Newtons per square meter with a maximum deflection of any stile of the assembly of L/175, where L is the length of the stile.

10. The window assembly of claim 1, wherein the inwardly extending flange is integrally attached to the jamb.

11. The window assembly of claim 1, wherein the assembly has a respective jamb on each side thereof, and the sash has a respective stile on each side thereof, each jamb having a respective inwardly extending flange that substantially prevents deflection of a respective stile.

12. The window assembly of claim 1, wherein the jamb has an additional inwardly extending flange that prevents the sash from pivoting outward, and the outwardly extending flange of the sash is slidably mounted between the inwardly extending flange of the jamb and the additional inwardly extending flange of the jamb.

13. A window assembly, comprising:

a frame having a jamb on at least a first side thereof;

a stop that is attachable to the jamb, the stop having a flange that extends inwardly when the stop is attached to the jamb; and a sash disposed within the frame, the sash having a stile with an outwardly extending flange along at least one portion of the stile adjacent the jamb, the outwardly extending flange being fixed relative to the sash, the outwardly extending flange of the stile being slidably movable adjacent to the inwardly extending flange of the stop, the sash having a first position in which the outwardly extending flange engages the flange of the stop, and the stile is substantially prevented from deflecting in a direction normal to a plane of the sash by the flange of the stop.

14. The window assembly of claim 13, wherein the sash has a second position in which an end of the outwardly extending flange is positioned beyond an end of the inwardly extending flange, and the outwardly extending flange does not engage the inwardly extending flange, allowing the sash to pivot relative to the frame.

15. The window assembly of claim 14, wherein the stop and the flange of the frame are hidden when the sash is in the first position.

16. The window assembly of claim 13, wherein the outwardly extending flange of the sash has first and second outwardly extending flange portions separated by a space or cutout.

17. The window assembly of claim 16, wherein the first outwardly extending flange portion extends to approximately a first end of the sash, and the second outwardly extending flange portion extends to approximately a second end of the sash opposite the first end of the sash.

18. The window assembly of claim 16, wherein the space or cutout is located at a distance from the bottom of the sash of approximately one third of the height of the sash.

19. The window assembly of claim 16, wherein the space or cutout is at least as long as the flange of the stop.

20. The window assembly of claim 13, wherein the stop is located at a height approximately equal to one half of the height of the sash.

21. The window assembly of claim 13, wherein the window has a test size of at least 1.5 meters× 2.4 meters, and the window is capable of sustaining a load of at least 1900 Newtons per square meter with a maximum deflection of any member of the assembly of L/175, where L is the length of the member.

22. The window assembly of claim 13, wherein the frame has a respective jamb on each side of the assembly, and the sash has a respective stile on each side thereof, each jamb having a respective inwardly extending flange that substantially prevents deflection of a respective stile.

23. The window assembly of claim 13, wherein the jamb has an additional inwardly extending flange that prevents the sash from pivoting outward, and the outwardly extending flange of the sash is slidably mounted between the inwardly extending flange of the jamb and the additional inwardly extending flange of the jamb.

* * * * *